United States Patent [19]

Nuesslein et al.

[11] Patent Number: 4,629,574

[45] Date of Patent: Dec. 16, 1986

[54] READY-TO-USE FABRIC SOFTENER CONCENTRATE

[75] Inventors: Hans Nuesslein, Langenfeld; Rolf Puchta, Haan; Theodor Voelkel, Duesseldorf, all of Fed. Rep. of Germany

[73] Assignee: Henkel Kommanditgesellschaft auf Aktien, Duesseldorf, Fed. Rep. of Germany

[21] Appl. No.: 597,142

[22] Filed: Apr. 5, 1984

[30] Foreign Application Priority Data

Apr. 22, 1983 [DE] Fed. Rep. of Germany ..... 3314677

[51] Int. Cl.[4] ..... D06M 13/46

[52] U.S. Cl. ..... 252/8.8; 252/8.6

[58] Field of Search ..... 252/8.8, 8.6, 8.75, 252/8.9

[56] References Cited

U.S. PATENT DOCUMENTS

| | | | |
|---|---|---|---|
| 3,681,241 | 8/1972 | Rudy | 252/8.75 |
| 3,920,561 | 11/1975 | DesMarais | 252/8.8 |
| 3,954,634 | 5/1976 | Monson et al. | 252/8.8 |
| 4,454,049 | 6/1984 | MacGlip | 252/8.8 |

FOREIGN PATENT DOCUMENTS

| | | | |
|---|---|---|---|
| 0032267 | 12/1980 | European Pat. Off. . | |
| 2256234 | 5/1973 | Fed. Rep. of Germany . | |
| 2352955 | 5/1974 | Fed. Rep. of Germany . | |
| 2459354 | 6/1976 | Fed. Rep. of Germany . | |
| 2811152 | 10/1978 | Fed. Rep. of Germany . | |
| 2845562 | 4/1979 | Fed. Rep. of Germany . | |
| 2841076 | 6/1979 | Fed. Rep. of Germany . | |
| 2905881 | 8/1980 | Fed. Rep. of Germany . | |
| 2911198 | 9/1980 | Fed. Rep. of Germany . | |
| 3019076 | 12/1980 | Fed. Rep. of Germany . | |
| 3026067 | 2/1982 | Fed. Rep. of Germany . | |
| 0710423 | 6/1954 | United Kingdom | 252/8.9 |

*Primary Examiner*—Paul Lieberman
*Assistant Examiner*—John F. McNally
*Attorney, Agent, or Firm*—Ernest G. Szoke; Henry E. Millson, Jr.; Mark A. Greenfield

[57] ABSTRACT

Aqueous, free-flowing concentrates containing a fabric-softening quaternary ammonium compound, an alkali metal soap or corresponding fatty acid, glycerol, and a water-soluble or water-miscible organic solvent. The soap or the corresponding fatty acid makes up from 1/70 to ⅓ of the quantity of fabric-softening quaternary ammonium compound, of which the concentrate contains at least 30% by weight.

28 Claims, No Drawings

READY-TO-USE FABRIC SOFTENER CONCENTRATE

BACKGROUND OF THE INVENTION

1. Field of the Invention

This invention relates to fabric treating compositions, and more particularly to an aqueous, free-flowing concentrate which contains fabric-softening quaternary ammonium compounds, a fatty acid and/or an alkali metal soap thereof, and a combination of solvents to impart immediate water dispersibility to the active substances of the concentrate.

2. Description of the Prior Art

It has long been known that the wearing comfort of fabrics can be improved by applying to them small quantities of cationic compounds, as a result of which a pleasant, soft feel and antistatic properties are imparted to the fabrics. The cationic compounds may be applied before and after the fabrics are worn, for example, in conjunction with washing. The cationic compounds may be applied to the fabric during the washing, rinsing or drying cycles.

The fabric softeners are utilized best when provision is made to ensure that they are absorbed onto the pieces of wash during rinsing. The most effective fabric softeners in terms of their softening power are quaternary, ammonia- or imidazoline-derived ammonium compounds containing at least two long-chain alkyl or alkenyl groups having from 10 to 20 carbon atoms. These compounds, however, are substantially insoluble in water and, for this reason, are added as dispersions to the rinse water. The content of the active substance in these dispersions usually is quite low; with the most common softener dispersions containing only about 5% by weight of softener. This means that a considerable quantity of water, which must be regarded as a diluent, is present in the dispersion during production, packaging, transport, storage and application. Accordingly, there have been many attempts to reduce the amount of water in softener dispersions and to produce more concentrated products.

Towards that end, for example, fabric softeners more soluble in water were developed (German Application No. 22 56 234); also significant quantities of organic solvents were added to the aqueous softener systems (German Application No. 24 59 354); or concentrated emulsions were prepared by introducing intense shear forces into the dispersions at elevated temperature (U.S. Pat. No. 3,954,634); or alkali nitrite or nitrate was added as an anti-gel agent (German Application No. 28 11 152); or the fabric softener dispersions were mixed with non-softening organic diluents, for example, with water-soluble polymers (German Application No. 30 19 076); with oil-like or fatty substances (German Application No. 28 45 562); with cellulose ethers (U.S. Pat. No. 3,920,561); with relatively high molecular weight amides (German Application No. 28 41 076); with long-chain hydrocarbons or amine derivatives (European Application No. 32 267); or with calcium or magnesium salts (German Application No. 29 05 881); or with aluminium salts (German Pat. No. 2,911,198). In some instances, several of these measures were combined (U.S. Pat. No. 3,681,241); also rinse-cycle softeners containing cationic quaternary ammonium compounds were combined with soap in a ratio of from 1:1 to 1:2 (German Application No. 23 52 955).

Unfortunately, these and other dispersions merely resulted in an unsatisfactory increase in concentration of the diluent-containing concentrates, and the added inorganic salts often deposited on the wash itself. These prior art concentrates also have a low flash point which makes them dangerous to handle, or they are difficult to dilute, or, in their diluted state, they have an inadequate softening effect. Additionally, they are not sufficiently fluid for convenient handling.

Accordingly, an object of the present invention is to provide ready-to-use, free-flowing fabric softener concentrates which have a high content of highly active, fabric-softening substances; which are convenient to handle and easy to dilute; which are highly effective in dilute form; and which do not have a low flash point.

DESCRIPTION OF THE INVENTION

The above object is achieved by a ready-to-use, free-flowing, measurable, aqueous fabric softener concentrate and a process for making the same. The concentrates of the invention contain a fabric-softening quaternary ammonium compound or compounds, an alkali metal soap or the corresponding fatty acids, or both, glycerol and other water-soluble or water-miscible, compatible organic solvents, and water. The alkali metal soap and/or the corresponding fatty acid constitute from 1/70 to ⅓ (1.43 to 33.33%) of the quantity (weight) of the fabric-softening quaternary ammonium compounds in the concentrate and the content of the quaternary ammonium compounds in the concentrate amounts to at least about 30% by weight of the concentrate.

The ready-to-use fabric softener concentrates of the invention additionally can contain non-ionic dispersants which inter alia improve the dispersibility of the active substances in water. The concentrates also contain a compatible acid with which the pH-value is adjusted to at least pH 6.

Organic solvents and acids for use in the context of the invention are those which are compatible with the remaining constituents of the concentrate and which, when the softener is used in the rinse cycle, do not damage either the pieces of wash or the washing machine or harm the user.

The concentrates of the invention can be adjusted to a consistency and fluidity which allows for convenient handling, i.e. the concentrates can readily be poured out from bottle openings ranging from about 3 to about 20 mm in diameter, and can readily be measured out by means of dispensers for liquids, for example, by means of the liquid container closure disclosed in German Application No. 30 26 067 which serves as a dispenser.

The solvent constituents of the concentrate of the invention, namely glycerol, organic solvents, and water, together are present in such quantities that the ratio by weight thereof to the weight of the textile-softening quaternary ammonium compounds is in the range of from about 1:6 to about 2:1 (i.e. 1:0.5–6), and is preferably less than 1:1 (i.e. 1:0.5–<1). In the particularly preferred embodiments of the concentrate of the invention, however, these quantities of solvent are significantly below 50% by weight. Accordingly, it is possible to make up the concentrate of the invention, for example, in the form of a so-called "6- or 10-fold concentrate" with good fluidity properties.

The preferred formulation for the concentrate of the invention contains the following constituents and quantities thereof:

(a) about 30 to about 70% by weight of fabric-softening, cationic quaternary ammonium compounds,
(b) about 1 to about 10% by weight of at least one $C_8$–$C_{20}$ fatty acid and/or an alkali metal salt thereof,
(c) about 2 to about 30% by weight of glycerol,
(d) about 5 to about 30% by weight of at least one organic solvent,
(e) 0 to about 20% by weight of at least one nonionic dispersant,
(f) about 5 to about 30% by weight of water, and
(g) at least one acid in such a quantity that the pH of the concentrate is below 6.

In the above formulation, the percentages by weight are based on the total weight of the concentrate.

Constituent (a)

Quaternary ammonium compounds that can be used herein include (and are preferably) those containing two long-chain, saturated or unsaturated aliphatic hydrocarbon groups, each with from 14 to 26 and, preferably 16 to 20 carbon atoms, and having at least one quaternary nitrogen atom in the molecule. The remaining two groups are preferably $C_1$–$C_6$ alkyl and/or $C_1$–$C_6$ hydroxyalkyl in which the alkyl portions thereof can be straight or branched chain, and wherein the hydroxyalkyl groups can optionally be reacted with from 1 to 6 moles of ethylene oxide. The long-chain aliphatic hydrocarbon groups can be linear or branched and, accordingly, can be derived from fatty acids or fatty amines, Guerbet amines, or from alkyl amines obtainable by the reduction of nitroparaffins. These quaternary ammonium compounds are derivatives of ammonia, i.e. the quaternary salts obtainable by alkylation of long-chain secondary amines, such as, for example, the compounds distearyl dimethylammonium chloride or ditallowalkyl dimethylammonium chloride or methosulfate, dioleyl dimethylammonium chloride or methosulfate, ditallowalkyl methylhydroxyethylammonium chloride or methosulfate or ditallowalkyl methylhydroxypropylammonium chloride or methosulfate or the adducts of 1 to 6 moles of ethylene oxide with the above hydroxyalkyl derivatives. Other suitable quaternary ammonium compounds are the imidazoline compounds obtainable by reacting 1 mole of an amino-lower alkyl ethylenediamine or hydroxy-lower alkyl ethylene diamine with 2 moles of a long-chain $C_{14}$–$C_{26}$ fatty acid or esters thereof and subsequently converted by alkylation with a lower alkyl alkylating agent, e.g. a lower alkyl chloride, into the quaternary imidazolinium compounds. In these quaternary ammonium compounds, the anion generally consists of the acid residue which is formed from the alkylating agent used in the quaternization reaction. Accordingly, the anion can be, for example, chloride, bromide, methylsulfate, ethylsulfate, methane sulfonate, ethane sulfonate, or toluene sulfonate.

Especially good results are obtained when the quaternary ammonium compounds are mixtures of imidazoline derivatives and ammonia derivatives each containing two $C_{14}$–$C_{26}$ alkyl or alkenyl groups, especially when the imidazoline derivatives contain two long-chain unsaturated groups, for example, oleyl groups, and such mixtures are particularly preferred for use herein.

Constituent (b)

The fatty acids and/or their alkali metal salts that can be used herein contain from 8 to 20 carbon atoms, and can be saturated or unsaturated fatty acids or mixtures thereof. The alkali metal salts, e.g. the potassium or preferably the sodium salts, of such fatty acids also can be used either alone or in admixture with other such alkali metal salts, or in admixture with one or more fatty acids. Examples of such fatty acids, which can also be in the form of their alkali metal salts, are mixtures wherein about 20% by weight is coconut oil fatty acid and about 80% by weight is tallow fatty acid, or mixtures wherein about 30% by weight is a mixture of $C_{16}$-fatty acids and, about 70% by weight is a mixture of $C_{18}$-fatty acids. In mixture with the quaternary ammonium compounds (a), these fatty acids and alkali soaps (b) are preferably present in an amount such that the ratio by weight of (a) to (b) is in the range of from about 20:1 to about 5:1.

Constituent (c)

Another essential constituent of the concentrates of the invention is glycerol. Preferably, the content of Constituent (b) and glycerol together amount to between about 5 and about 30% by weight of the concentrate.

Constituent (d)

Compatible, water-miscible organic solvents, which can be used alone or in mixtures herein, are, for example, alkanols containing from 1 to 4 carbon atoms or lower ($C_1$–$C_6$)alkylene diols. Examples of these compounds are ethanol, isopropyl alcohol, ethylene glycol, propylene glycol or dipropylene glycol. Polyols containing ether bonds, such as, for example, methyl, ethyl, butyl glycol or diethylene glycol or acetic acid esters thereof are also suitable solvents. In many instances, organic solvents of the present type are also standard constituents of commercially available fabric softeners containing quaternary ammonium compounds.

Constituent (f)

Non-ionic dispersants which can optionally be present in the concentrate of the invention are adducts of from 4 to 40 moles, and preferably from 4 to 20 moles, of ethylene oxide with either 1 mole of an aliphatic $C_{10}$–$C_{20}$ alcohol or of an alkyl phenol in which the alkyl radical contains from 8 to 18 carbon atoms, or with 1 mole of a fatty acid or an alkyl amine containing from 10 to 20 carbon atoms. Particularly preferred non-ionic dispersants are the ethoxylation products of fatty alcohols, particularly coconut oil and tallow fatty alcohols, and of oleyl alcohol, and also ethoxylation products of oxoalcohols and secondary alcohols having the above stated chain lengths. Other suitable non-ionic dispersants are the water-soluble adducts-containing from 20 to 250 ethylene glycol ether groups and from 10 to 100 propylene glycol ether groups-of ethylene oxide with propylene glycol or with alkylene diamine polypropylene glycol or with alkyl polypropylene glycols containing from 1 to 10 carbon atoms in which the polypropylene glycol chain acts as a hydrophobic radical. One example of a suitable dispersant is the adduct of 9.5 moles of ethylene oxide with nonyl phenol. Liquid paraffin oil hydrocarbons are also suitable dispersants.

Constituent (g)

The concentrate according to the invention preferably has a pH below 6. This is important since, even after dilution with 10 times the quantity of water, the concentrate should preferably still show an acid reaction. Concentrates which, in undiluted form, have a pH of from about 3 to about 6 satisfy this requirement and, accordingly, are preferred. Acids compatible with fabrics and with the constituent materials of washing machines, such as inorganic acids, for example, hydrochloric acid, sulfuric acid, phosphoric acid, boric acid, or organic acids, such as, for example, formicacid, acetic acid, benzoic acid, lactic acid, glycolic acid, and especially citric acid, are suitable for adjusting the pH of the concentrate below 6.

Other Constituents

In addition to the constituents set forth above, the concentrate can contain other additives and auxiliaries normally present in fabric treatment agents in concentrations of up to about 10% by weight. Such standard constituents include antimicrobial agents, optical brighteners, soluble salts for adjusting the density of the concentrate, up to 0.01% by weight of dyes, and up to about 5% by weight of fragrances.

According to the invention, by adding small quantities of salts, such as, for example, about 1.5% by weight of sodium chloride or sodium acetate, it is possible to increase the density of the concentrate, should such increased density be desired.

The concentrates of the invention are best prepared by mixing the liquefied (if necessary by heating) fabric-softening agent with the rest of the constituents, the solid constituents being mixed in last. Accordingly, the liquid or thermally liquefied fabric-softening agent of quaternary ammonium compounds containing two $C_{14}$–$C_{26}$ alkyl or alkenyl groups is mixed with glycerol, organic water-miscibile solvents, water, and a dispersant, if employed, together with the pH regulating acid when present in liquid form, followed by the fatty acids and/or alkali metal salts thereof and the pH regulating acid when present in solid form.

The concentrate according to the invention is distinguished by excellent dilutability with water and by good fabric-softening and antistatic effects. It is used by addition thereof to the final-rinse water in a concentration of from about 0.2 to about 1 g per liter.

EXAMPLES

Concentrates according to the invention having the composition set forth below in the Table were prepared by mixing the liquid fabric softener (softener 1) or the mixture of liquid fabric softener (softener 1) and fabric softener liquefied by heating to 60° C. (softener 2) with the other liquid constituents, and subsequently introducing the solid constituents, if any.

The abbreviations used in the following formulations have the following meaning:

Softener 1
=methyl-1-tallowalkylamidoethyl-2-tallowalkyl imidazolinium methosulfate, 75% by weight solution in isopropyl alcohol/water 1:1, Softener 2
=distearyl dimethylammonium chloride, 75% by weight solution in isopropyl alcohol/water 1:1, Soap A
=sodium salt of a mixture of 20% by weight of coconut oil fatty acid and 80% by weight of tallow fatty acid, Soap B
=sodium salt of a mixture of 30% by weight of $C_{16}$-fatty acid and 70% by weight of $C_{18}$-fatty acid, Fatty acid B
=fatty acid of soap B, Emulsifier I (Dispersant)
=nonylphenol +9.5 moles of ethylene oxide, Emulsifier II (Dispersant)
=thin-flowing paraffin oil, DAB 7.

TABLE

| | Examples | | | | | | | | | |
|---|---|---|---|---|---|---|---|---|---|---|
| Constituent | 1 | 2 | 3 | 4 | 5 | 6 | 7 | 8 | 9 | 10 |
| Softener 1 | 52.5 | 52.5 | 52.5 | 45 | 52.5 | 52.5 | 50 | 40 | 45 | 45 |
| Softener 2 | | | | 5 | 5 | | | | | |
| Soap A | 5 | | 5 | | 5 | 5 | 4 | | | |
| Soap B | | 5 | | 5 | | | | 5 | | |
| Fatty acid B | | | | | | | | | 3 | 3 |
| Glycerol | 13 | 8 | 13 | 10 | 4 | 5 | 9 | 15 | 9 | 11 |
| 1,2-propylene glycol | | | | | | | 8 | | | |
| Dipropylene glycol | | | | | | | | 10 | 5 | 5 |
| Isopropyl alcohol | 17.5 | 17.5 | 17.5 | 16.7 | 17.5 | 17.5 | | | 15 | 15 |
| Emulsifier I | — | | | | 1 | | 10 | 6 | 2 | 2 |
| Emulsifier II | | | | | | | | | 4 | |
| Citric acid | 3.5 | 3 | 3 | 3.5 | 3 | 3 | | | 2 | 2 |
| Formic acid | | | | | | | 1.5 | 2 | | |
| Sodium chloride | | | | 1.5 | | | | | 1.5 | 1.5 |
| Dye | | | 0.0025 | | 0.0025 | 0.0035 | | | | |
| Fragrance | 2 | 2 | 2 | 2 | 3 | 2 | 2 | 2 | 2.5 | 2.5 |
| Water | | | | | balance | | | | | |

In the above Table, the numbers given represent percentages by weight, based on the total weight of the concentrate.

When 4 kg (dry weight) of freshly washed laundry was treated for 5 minutes in the final rinse of an automatic domestic washing machine with the rinse water at 15° C. to which 10 g of the concentrate of Example 1 had been added, 20 liters of rinsing water acting on the wash, fabrics having a full, soft feel and a pleasant fragrance were obtained after the wash had been dried. The above procedure was repeated with each of the concentrates of Examples 2 through 10, and in each instance the same beneficial results were obtained. The feel and fragrance of these fabrics were comparable with those of comparison fabrics which had been treated with 100 g of a commercially available fabric softener containing 5.0% by weight of softening agent and 0.5% by weight of fragrance, by adding the commercially available fabric softener to the final-rinse water.

While the invention has been described with particular reference to certain embodiments thereof, it will be understood that changes and modifications may be made which are within the skill of the art. Accordingly, it is intended to be bound by the accompanying claims only.

What is claimed is:

1. A ready-to-use, aqueous, free-flowing fabric softener concentrate consisting essentially of:

(a) about 30–70% by weight of at least one fabric softening cationic quaternary ammonium compound;

(b) about 0.43 to 23.33% by weight of at least one $C_{8-20}$ fatty acid or alkali metal salt thereof;

(c) glycerol solvent;

(d) a compatible, water-miscible organic solvent which is at least one $C_{1-4}$ alkanol or $C_{1-6}$ alkylene diol; and (e) water solvent;

wherein the ratio by weight of the sum of solvent components (c), (d), and (e) to fabric softening component (a) is about 1:0.5–6; all percentages by weight being based upon the total weight of said concentrate.

2. The fabric softener concentrate of claim 1 wherein the said ratio is 1:0.5–<1.

3. The fabric softener concentrate of claim 1 wherein:

(b) said fatty acid or salt component is present in about 1 to 10% by weight;

(c) said glycerol component is present in about 2 to 30% by weight;

(d) said organic solvent component is present in about 5 to 30% by weight;

(e) said water component is present in about 5 to 30% by weight;

and wherein said concentrate also contains:

(f) 0 to about 20% of a nonionic dispersant; and (g) at least one compatible acid in a quantity sufficient to adjust the pH of said concentrate to more acid than about 6.

4. The fabric softener concentrate of claim 3 wherein said ratio is 1:0.5<1.

5. The fabric softener concentrate of claim 1 wherein component (a) is a mixture of at least one quaternary ammonium compound derived from ammonia and at least one quaternary ammonium compound derived from imidazoline, wherein said quaternary ammonium compounds each contain two $C_{14-26}$ alkyl or alkenyl moieties.

6. The fabric softener concentrate of claim 3 wherein component (a) is a mixture of at least one quaternary ammonium compound derived from ammonia and at least one quaternary ammonium compound derived from imidazoline, wherein said quaternary ammonium compounds each contain two $C_{14-16}$ alkyl or alkenyl moieties.

7. The fabric softener concentrate of claim 1 wherein the weight ratio of component (a) to component (b) is about 5–20:1.

8. The fabric softener concentrate of claim 3 wherein the weight ratio of component (a) to component (b) is about 5–20:1.

9. The fabric softener concentrate of claim 1 wherein the sum of the quantities of components (b) and (c) are about 5 to 30% by weight of the total weight of said concentrate.

10. The fabric softener concentrate of claim 3 wherein the sum of the quantities of components (b) and (c) are about 5 to 30% by weight of the total weight of said concentrate.

11. The fabric softener concentrate of claim 1 wherein the pH of said concentrate is about 3 to 6.

12. The fabric softener concentrate of claim 3 wherein the pH of said concentrate is about 3 to 6.

13. The fabric softener concentrate of claim 1 wherein said compatible acid of component (g) is citric acid.

14. The fabric softener concentrate of claim 3 wherein said compatible acid of component (g) is citric acid.

15. The fabric softener concentrate of claim 3 wherein:

component (a) is a mixture of at least one quaternary compound derived from ammonia and at least one quaternary ammonium compound derived from imidazoline, wherein said quaternary ammonium compounds each contain two $C_{14-26}$ alkyl or alkenyl moieties;

the weight ratio of component (a) to component (b) is about 5–20:1;

the sum of the quantities of components (b) and (c) are about 5 to 30% by weight of the total weight of said concentrate;

the said ratio of the sum of components (c), (d) and (e) to component (a) is about 1:0.5<1;

the pH of said concentrate is about 3 to 6; and the compatible acid of component (g) is citric acid.

16. An aqueous fabric softener solution containing about 0.2 to 1 g/l of the fabric softener concentrate of claim 1.

17. An aqueous fabric softener solution containing about 0.2 to 1 g/l of the fabric softener concentrate of claim 15.

18. The fabric softener concentrate of claim 3 wherein:

component (a) is: (i) methyl-1-tallowalkyl-amidoethyl-2-tallowalkylimidazolinium methosulfate in a 75% by weight solution of equal parts of isopropylalcohol and water; (ii) distearyl dimethylammonium chloride in a 75% by weight solution of equal parts of isopropyl alcohol and water; or a mixture thereof;

component (b) is: (i) the sodium salt of a mixture of 20% by weight of coconut oil fatty acid and 80% by weight of tallow fatty acid; (ii) the sodium salt of a mixture of 30% by weight of $C_{16}$-fatty acid and 70% by weight of $C_{18}$-fatty acid; or (iii) a mixture of 30% by weight of $C_{16}$-fatty acid and 70% by weight of $C_{18}$-fatty acid;

component (c) is glycerol;

component (d) is: (i) 1,2-propylene glycol; (ii) dipropylene glycol: (iii) isopropyl alcohol; or (iv) a mixture of dipropylene glycol and isopropyl alcohol;

component (e) is water;

component (f) is: (i) nonylphenol +9.5 mols of ethylene oxide; (ii) thin-flowing paraffin oil, DAB 7: or (iii) a mixture thereof;

component (g) is: (i) citric acid; or (ii) formic acid;

a further component (h) which is: (i) sodium chloride; or (ii) sodium acetate; may be present to increase density;

a further component (j) which is a dye may be present; and a further component (k) which is a fragrance may be present.

19. The fabric concentrate of claim 18 wherein the following components are present in the following percentages by weight, all based upon the total weight of said concentrate:

| Component | % by weight |
|---|---|
| a (i) | 52.5 |
| b (i) | 5. |
| c | 13. |
| d (iii) | 17.5 |
| e | q.s. to 100% |
| g (i) | 3.5 |
| k | 2. |

20. The fabric concentrate of claim 18 wherein the following components are present in the following percentages by weight, all based upon the total weight of said concentrate:

| Component | % by weight |
|---|---|
| a (i) | 52.5 |
| b (ii) | 5. |
| c | 8. |
| d (iii) | 17.5 |
| e | q.s. to 100% |
| g (i) | 3. |
| k | 2. |

21. The fabric concentrate of claim 18 wherein the following components are present in the following percentages by weight, all based upon the total weight of said concentrate:

| Component | % by weight |
|---|---|
| a (i) | 52.5 |
| b (i) | 5. |
| c | 13. |
| d (iii) | 17.5 |
| e | q.s. to 100% |
| g (i) | 3. |
| j | 0.0025 |
| k | 2. |

22. The fabric concentrate of claim 18 wherein the following components are present in the following percentages by weight, all based upon the total weight of said concentrate:

| Component | % by weight |
|---|---|
| a (i) | 45. |
| a (ii) | 5. |
| b (ii) | 5. |
| c | 10. |
| d (iii) | 16.7 |
| e | q.s. to 100% |
| g (i) | 3.5 |
| h (i) | 1.5 |
| k | 2. |

23. The fabric concentrate of claim 18 wherein the following components are present in the following percentages by weight, all based upon the total weight of said concentrate:

| Component | % by weight |
|---|---|
| a (i) | 52.5 |
| a (ii) | 5. |
| b (i) | 5. |
| c | 4. |
| d (iii) | 17.5 |
| e | q.s. to 100% |
| f (i) | 1. |
| g (i) | 3. |

-continued

| Component | % by weight |
|---|---|
| j | 0.0025 |
| k | 3. |

24. The fabric concentrate of claim 18 wherein the following components are present in the following percentages by weight, all based upon the total weight of said concentrate:

| Component | % by weight |
|---|---|
| a (i) | 52.5 |
| b (i) | 5. |
| c | 5. |
| d (iii) | 17.5 |
| e | q.s. to 100% |
| g (i) | 3. |
| j | 0.0035 |
| k | 2. |

25. The fabric concentrate of claim 18 wherein the following components are present in the following percentages by weight, all based upon the total weight of said concentrate:

| Component | % by weight |
|---|---|
| a (i) | 50. |
| b (i) | 4. |
| c | 9. |
| d (i) | 8. |
| e | q.s. to 100% |
| f (i) | 10. |
| g (ii) | 1.5 |
| k | 2. |

26. The fabric concentrate of claim 18 wherein the following components are present in the following percentages by weight, all based upon the total weight of said concentrate:

| Component | % by weight |
|---|---|
| a (i) | 40. |
| b (ii) | 5. |
| c | 15. |
| d (ii) | 10 |
| e | q.s. to 100% |
| f (i) | 6. |
| g (ii) | 2. |
| k | 2. |

27. The fabric concentrate of claim 18 wherein the following components are present in the following percentages by weight, all based upon the total weight of said concentrate:

| Component | % by weight |
|---|---|
| a (i) | 45. |
| b (iii) | 3. |
| c | 9. |
| d (ii) | 5. |
| d (iii) | 15. |
| e | q.s. to 100% |
| f (i) | 2. |
| f (ii) | 4. |
| g (i) | 2. |
| h (i) | 1.5 |
| k | 2.5 |

28. The fabric concentrate of claim 18 wherein the following components are present in the following percentages by weight, all based upon the total weight of said concentrate:

| Component | % by weight |
|---|---|
| a (i) | 45. |
| b (iii) | 3. |

-continued

| Component | % by weight |
|---|---|
| c | 11. |
| d (ii) | 5. |
| d (iii) | 15. |
| e | q.s. to 100% |
| f (i) | 2. |
| g (i) | 2. |
| h (i) | 1.5 |
| k | 2.5 |

* * * * *